US011760586B2

(12) United States Patent
Yoshida

(10) Patent No.: US 11,760,586 B2
(45) Date of Patent: Sep. 19, 2023

(54) SHEET FEED DEVICE, IMAGE FORMING APPARATUS

(71) Applicant: KYOCERA Document Solutions Inc., Osaka (JP)

(72) Inventor: Takeshi Yoshida, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 267 days.

(21) Appl. No.: 17/468,381

(22) Filed: Sep. 7, 2021

(65) Prior Publication Data

US 2022/0081234 A1 Mar. 17, 2022

(30) Foreign Application Priority Data

Sep. 16, 2020 (JP) ..... 2020-155401

(51) Int. Cl.

| | |
|---|---|
| ***B65H 1/14*** | (2006.01) |
| ***B65H 3/06*** | (2006.01) |
| ***B65H 3/46*** | (2006.01) |
| ***B65H 1/26*** | (2006.01) |

(52) U.S. Cl.

CPC ..... *B65H 1/14* (2013.01); *B65H 1/266* (2013.01); *B65H 3/0607* (2013.01); *B65H 3/46* (2013.01)

(58) Field of Classification Search

CPC . B65H 1/04; B65H 1/14; B65H 1/266; B65H 3/46; B65H 3/0607; B65H 3/0638; B65H 3/0684

USPC ..... 271/109, 117, 162, 164, 167, 273

See application file for complete search history.

(56) References Cited

U.S. PATENT DOCUMENTS

| | | | | |
|---|---|---|---|---|
| 7,435,025 | B2 * | 10/2008 | Tanahashi | B65H 3/56 271/118 |
| 8,430,394 | B2 * | 4/2013 | Uehara | B65H 3/0669 271/118 |
| 9,663,311 | B2 * | 5/2017 | Tanio | G03G 15/6511 |
| 9,731,918 | B2 * | 8/2017 | Lee | B65H 1/12 |
| 10,486,922 | B2 * | 11/2019 | Horita | B65H 3/0684 |

FOREIGN PATENT DOCUMENTS

| | | | |
|---|---|---|---|
| JP | 2012082049 A | * | 4/2012 |
| JP | 2018080047 A | * | 5/2018 |
| JP | 2018080047 A | | 5/2018 |
| JP | 2018100135 A | * | 6/2018 |

* cited by examiner

*Primary Examiner* — Leslie A Nicholson, III
(74) *Attorney, Agent, or Firm* — Alleman Hall Creasman & Tuttle LLP

(57) ABSTRACT

A holder supports a separation member. When a sheet cassette is attached to a main body portion, as the sheet cassette is moved in its attachment direction, a moving mechanism causes the holder to move from an initial position to an operation position. When the holder is at the initial position, the separation member is spaced from a feeding member and is able to pass below the feed-out member. When at the operation position, the holder presses the separation member against the feeding member. When the sheet cassette is attached to the main body portion, the moving mechanism causes the holder to move to the operation position after the separation member passes below the feed-out member. When the sheet cassette is drawn from the main body portion, the moving mechanism causes the holder to move to the initial position before the separation member reaches below the feed-out member.

6 Claims, 4 Drawing Sheets

SHEET FEED DEVICE, IMAGE FORMING APPARATUS

INCORPORATION BY REFERENCE

This application is based upon and claims the benefit of priority from the corresponding Japanese Patent Application No. 2020-155401 filed on Sep. 16, 2020, the entire contents of which are incorporated herein by reference.

BACKGROUND

The present disclosure relates to a sheet feed device including a sheet cassette and a mechanism for feeding a sheet from the sheet cassette, and to an image forming apparatus including the sheet feed device.

An image forming apparatus includes a sheet feed device. The sheet feed device includes a sheet cassette and a sheet feed-out mechanism, wherein the sheet cassette is attached to a main body portion in such a way as to be drawable from the main body portion, and the sheet feed-out mechanism feeds a sheet from the sheet cassette to a conveyance path that is formed in the main body portion.

The sheet feed-out mechanism includes a pickup roller, a feed roller, and a separation member. The feed roller and the separation member are disposed in a state of being in contact with each other at a downstream of the pickup roller in a sheet feed direction.

The pickup roller rotates while in contact with an upper surface of a top sheet of a plurality of sheets stored in the sheet cassette. This allows the pickup roller to feed the top sheet of the plurality of sheets from the sheet cassette toward the downstream.

The feed roller rotates while in contact with the upper surface of the sheet fed by the pickup roller. This allows the feed roller to take over the feeding out of the sheet from the pickup roller and feed the sheet to the conveyance path in the main body portion.

The separation member is configured to come in contact with a lower surface of the sheet fed by the feed roller. If the pickup roller feeds a plurality of sheets from the sheet cassette, the separation member intercepts the second and following sheets from top among the plurality of sheets. The separation member is, for example, a retard roller or a separation pad.

For example, there is known a configuration where a feed unit including the pickup roller, the feed roller, and the retard roller is disposed in the main body portion.

SUMMARY

A sheet feed device according to an aspect of the present disclosure includes a sheet cassette, a feed-out member, a feeding member, a separation member, a holder, a holder support portion, and a moving mechanism. The sheet cassette stores sheets and is attached, along an attachment direction which is directed from an upstream side to a downstream side in a sheet feed direction, to a main body portion, the sheet cassette configured to be drawn from the main body portion in a direction opposite to the attachment direction. The feed-out member is provided in the main body portion and configured to come in contact with an upper surface of a sheet in the sheet cassette to feed out the sheet in the sheet feed direction. The feeding member is configured to feed the sheet fed out by the feed-out member to a conveyance path in the main body portion. The separation member is disposed to face the feeding member from below and configured to, together with the feeding member, separate the sheets one by one and feed a separated sheet. The holder supports the separation member. The holder support portion is provided in the sheet cassette and supports the holder such that the holder can move in an up-down direction. The moving mechanism is provided in the main body portion. When the sheet cassette is attached to the main body portion, as the sheet cassette is moved in the attachment direction, the moving mechanism causes the holder to move from an initial position to an operation position. When the holder is located at the initial position, the separation member is spaced from the feeding member and is able to pass below the feed-out member. When the holder is located at the operation position, the holder presses the separation member against the feeding member. When the sheet cassette is attached to the main body portion, the moving mechanism causes the holder to move from the initial position to the operation position after the separation member passes below the feed-out member. When the sheet cassette is drawn from the main body portion, the moving mechanism causes the holder to move from the operation position to the initial position before the separation member reaches below the feed-out member.

An image forming apparatus according to another aspect of the present disclosure includes the sheet feed device and a print portion configured to form an image on a sheet fed by the sheet feed device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
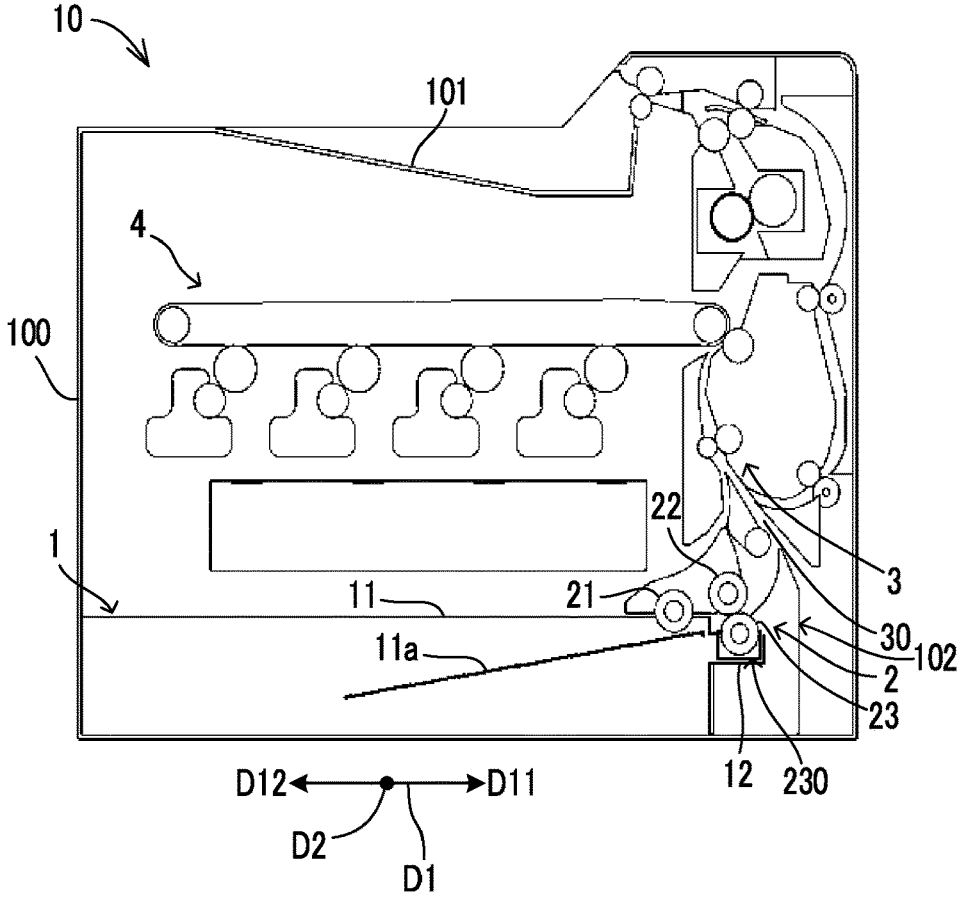
FIG. 1 is a configuration diagram of an image forming apparatus according to an embodiment.
Figure 2:
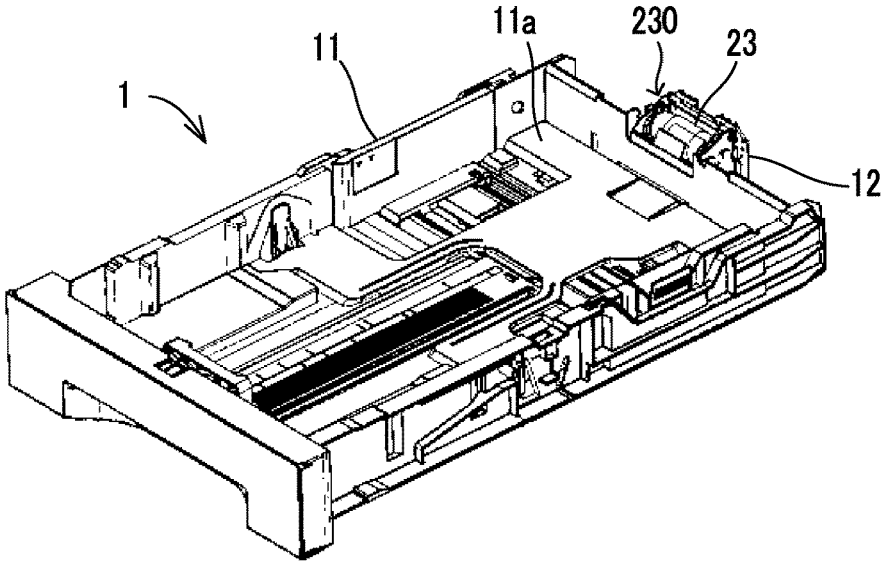
FIG. 2 is a perspective diagram of a sheet cassette to which a separation unit is attached in the image forming apparatus according to the embodiment.
Figure 3:
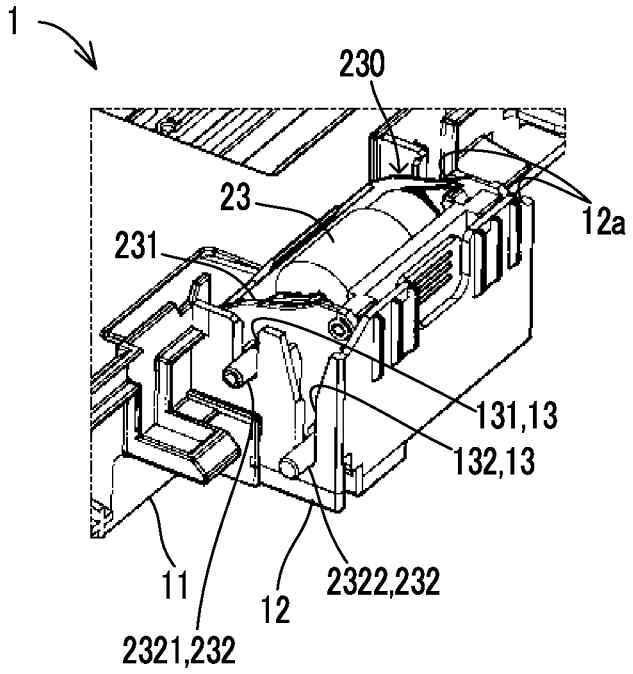
FIG. 3 is a perspective diagram of a holder support portion to which the separation unit is attached in the image forming apparatus according to the embodiment.
Figure 4:
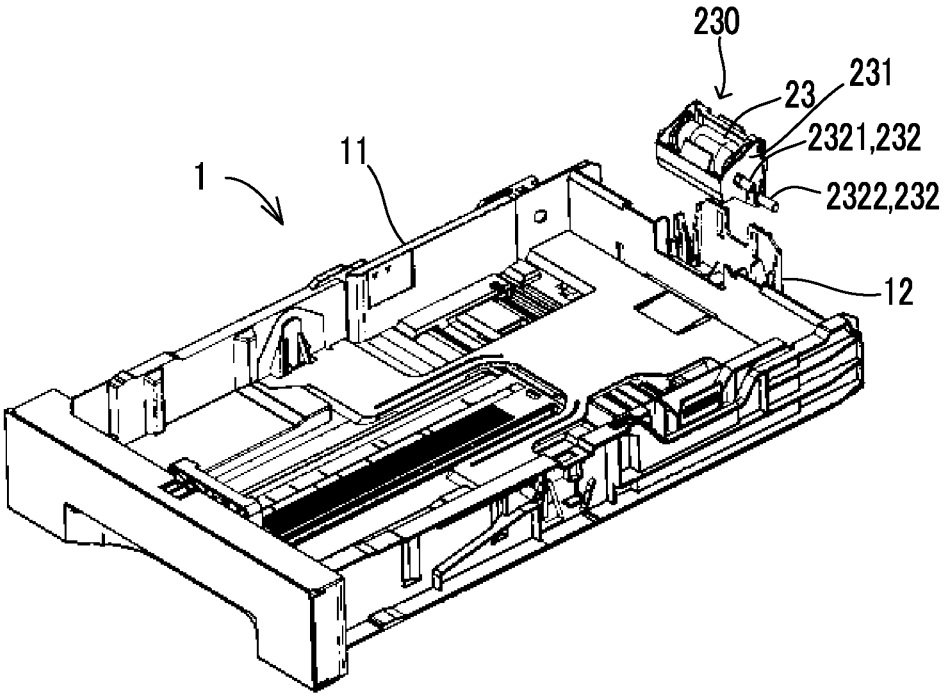
FIG. 4 is a perspective diagram of the separation unit and the sheet cassette of the image forming apparatus according to the embodiment.

The following describes an embodiment of the present disclosure with reference to the accompanying drawings. It should be noted that the following embodiment is an example of a specific embodiment of the present disclosure and should not limit the technical scope of the present disclosure.

[Configuration of Image Forming Apparatus 10]

An image forming apparatus 10 according to the embodiment includes a sheet cassette 1, a sheet feed-out mechanism 2, a sheet conveying mechanism 3, and a print portion 4.

The sheet conveying mechanism 3 and the print portion 4 are provided in a main body portion 100. The main body portion 100 is a housing of the image forming apparatus 10.

The sheet cassette 1 stores sheets, and is attached to the main body portion 100 in such a way as to be drawable from the main body portion 100 along a first direction D1. The sheets are image formation media such as sheets of paper or sheets of synthetic resin.

The first direction D1 is a depth direction of the image forming apparatus 10. In the following description, a horizontal direction perpendicular to the first direction D1 is referred to as a second direction D2. The second direction D2 is a width direction of the image forming apparatus 10.

Figure 6:
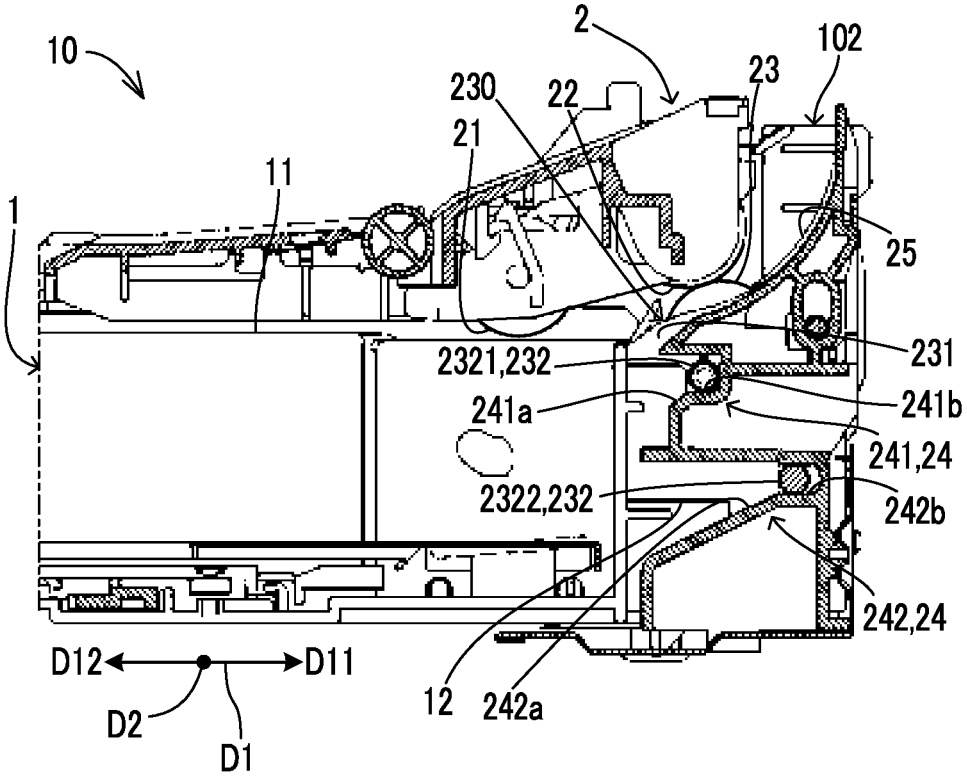
FIG. 6 is a cross-sectional diagram of a sheet feed-out mechanism in a state where the sheet cassette is attached to the image forming apparatus according to the embodiment.
Figure 7:
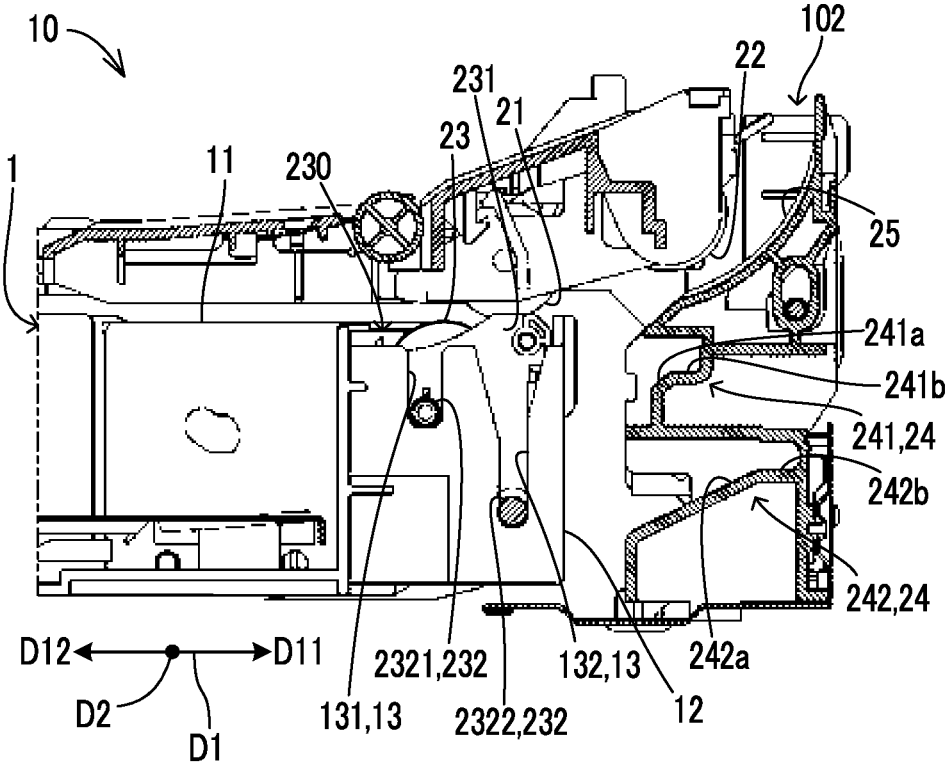
FIG. 7 is a cross-sectional diagram of the sheet feed-out mechanism in a state where the sheet cassette has been drawn from the image forming apparatus according to the embodiment.

In FIG. 1, FIG. 6, and FIG. 7, the sign D11 indicates an attachment direction D11 in which the sheet cassette 1 is attached to the main body portion 100 along the first direction D1. In addition, the sign D12 indicates a drawing direction D12 in which the sheet cassette 1 is drawn from the main body portion 100 along the first direction D1. The attachment direction D11 is directed from the front to the rear of the image forming apparatus 10.

The sheet feed-out mechanism 2 feeds a sheet from the sheet cassette 1 to a conveyance path 30 that is formed in the main body portion 100. The sheet cassette 1 and the sheet feed-out mechanism 2 constitute a sheet feed device that feeds the sheet to the conveyance path 30. The sheet cassette 1 is attached to a predetermined attachment position in the main body portion 100, from upstream in a sheet feed direction in which the sheet is fed by the sheet feed device. FIG. 6 shows a state where the sheet cassette 1 is attached to the attachment position. The sheet cassette 1 can be drawn from the attachment position in the drawing direction D12. The drawing direction D12 is opposite to the sheet feed direction.

The sheet conveying mechanism 3 conveys the sheet along the conveyance path 30, and discharges the sheet from the conveyance path 30 onto a discharge tray 101.

The print portion 4 is a device that executes a print process to form an image on the sheet conveyed along the conveyance path 30. That is, the print portion 4 forms an image on the sheet fed by the sheet feed device.

In the example shown in FIG. 1, the print portion 4 executes the print process by an electrophotographic method. It is noted that the print portion 4 may be a device that executes the print process by another method such as an inkjet method.

The sheet feed-out mechanism 2 includes a pickup roller 21, a feed roller 22, and a retard roller 23. The feed roller 22 and the retard roller 23 are disposed in a state of being in contact with each other at a downstream of the pickup roller 21 in the sheet feed direction.

That is, the feed roller 22 is disposed at a downstream of the pickup roller 21 in the attachment direction D11, at an upper position than the pickup roller 21. In other words, the pickup roller 21 is disposed at a downstream of the feed roller 22 in the drawing direction D12, at a lower position than the feed roller 22.

The pickup roller 21 rotates while in contact with an upper surface of a top sheet of a plurality of sheets stored in the sheet cassette 1. This allows the pickup roller 21 to feed the top sheet of the plurality of sheets from the sheet cassette 1 to between the feed roller 22 and the retard roller 23. The pickup roller 21 is an example of a feed-out member that comes in contact with an upper surface of the sheet in the sheet cassette 1 to feed out the sheet in the sheet feed direction.

The feed roller 22 rotates while in contact with the upper surface of the sheet fed out by the pickup roller 21. This allows the feed roller 22 to take over the feeding out of the sheet from the pickup roller 21 and feed the sheet to the conveyance path 30 in the main body portion 100. It is noted that the feed roller 22 is an example of a feeding member that feeds the sheet fed by the pickup roller 21 to the conveyance path 30 in the main body portion 100.

The retard roller 23 is disposed to face the feed roller 22 from below. The retard roller 23 comes in contact with a lower surface of the sheet fed by the feed roller 22. If the pickup roller 21 feeds a plurality of sheets from the sheet cassette 1, the retard roller 23 intercepts the second and following sheets from top among the plurality of sheets.

The retard roller 23 is an example of a separation member that separates the top sheet from the remaining sheets among a plurality of sheets. The retard roller 23 is configured to, together with the feed roller 22, separate the sheets one by one and feed the separated sheet to the conveyance path 30.

For example, the retard roller 23 rotates in a direction for the sheet to return toward the sheet cassette 1. In addition, there may be a case where a torque limiter is disposed between the retard roller 23 and a rotary shaft of the retard roller 23. In addition, there may be a case where a separation pad is adopted as the separation member in place of the retard roller 23.

Meanwhile, the retard roller 23 is easily deteriorated since it frequently rubs sheets. As a result, it is desired that even users can easily replace the retard roller 23. It is noted that, as is the case with the retard roller 23, it is desired that even users can easily replace the separation pad.

On the other hand, it is undesirable to provide, in the main body portion 100, a cover that can be opened and closed when the retard roller 23 is replaced, since it leads to increase in the number of parts and assembly steps of the image forming apparatus 10.

The image forming apparatus 10 has a structure to facilitate the replacement of the retard roller 23 of the sheet feed-out mechanism 2. The following describes the structure.

In the sheet feed-out mechanism 2 of the image forming apparatus 10, the pickup roller 21 and the feed roller 22 are provided in the main body portion 100. On the other hand, a separation unit 230 including the retard roller 23 is supported by the sheet cassette 1.

The sheet cassette 1 includes a cassette main body 11 and a holder support portion 12, wherein the cassette main body 11 stores the sheets, and the holder support portion 12 is provided at a forward end of the cassette main body 11 in the attachment direction D11. That is, the holder support portion 12 is provided on a front surface of the sheet cassette 1 in the attachment direction D11. The separation unit 230 is supported by the holder support portion 12 in such a way as to be movable in the up-down direction.

The separation unit 230 includes the retard roller 23 and a holder 231 (see FIG. 3, FIG. 4, FIG. 6, FIG. 7). The holder 231 rotatably supports the retard roller 23. The holder 231 includes a plurality of protruding portions 232 that protrude outward from both sides of the holder 231 along a direction crossing the attachment direction D11 (see FIG. 3, FIG. 4, FIG. 6, FIG. 7). The plurality of protruding portions 232 are formed along the second direction D2.

In the present embodiment, the holder 231 is placed on the holder support portion 12. The holder 231 is attached on the sheet cassette 1 by being placed on the holder support portion 12. As a result, the separation unit 230 is removed from the sheet cassette 1 by being lifted from the holder support portion 12.

In the present embodiment, the plurality of protruding portions 232 include a pair of first protruding portions 2321 and a pair of second protruding portions 2322, wherein the first protruding portions 2321 coaxially project in opposite directions, and the second protruding portions 2322 coaxially project in opposite directions. The pair of second protruding portions 2322 are disposed at a downstream of the pair of first protruding portions 2321 in the attachment direction D11, at a lower position than the pair of first protruding portions 2321.

On the other hand, the holder support portion 12 of the sheet cassette 1 includes a plurality of unit guide portions 13 that respectively guide the plurality of protruding portions 232 in the up-down direction. The plurality of unit guide portions 13 include a pair of first unit guide portions 131 and a pair of second unit guide portions 132, wherein the pair of first unit guide portions 131 guide the pair of first protruding portions 2321 in the up-down direction, and the pair of second unit guide portions 132 guide the pair of second protruding portions 2322 in the up-down direction.

The plurality of unit guide portions 13 are cuts of a recessed shape formed by being cut downward from an upper edge of the holder 231. It is noted that the plurality of unit guide portions 13 are an example of a plurality of support grooves.

Figure 5:
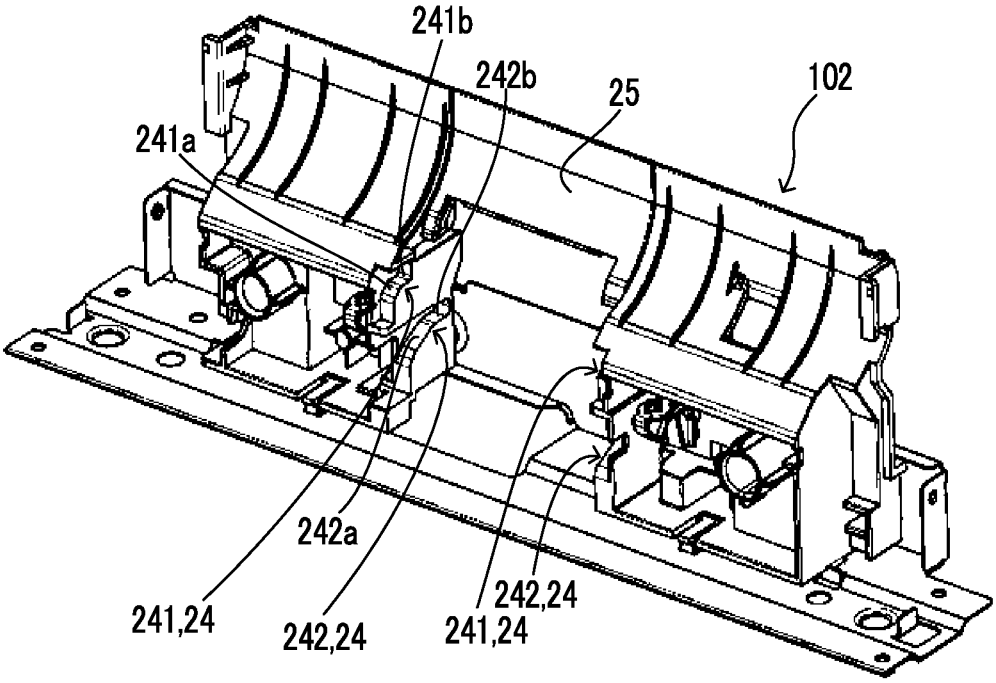
FIG. 5 is a perspective diagram of a cassette facing portion of the image forming apparatus according to the embodiment.

In addition, the main body portion 100 includes a cassette facing portion 102 that faces, in the drawing direction D12, a forward end portion of the sheet cassette 1 (see FIG. 1, FIG. 5). That is, the cassette facing portion 102 faces a front surface portion of the sheet cassette 1. The cassette facing portion 102 includes a plurality of unit regulating portions 24 and a feed sheet guide 25.

The feed sheet guide 25 guides the sheet fed by the feed roller 22 to the conveyance path 30.

When the sheet cassette 1 is attached to the main body portion 100, the plurality of unit regulating portions 24 come in contact with the plurality of protruding portions 232 of the separation unit 230, and as the sheet cassette 1 is moved in the attachment direction D11, the unit regulating portions 24 cause the separation unit 230 to move from an initial position to an operation position, and hold the separation unit 230 at the operation position (see FIG. 6). It is noted that in the present embodiment, the initial position and the operation position are positions of the holder 231.

FIG. 6 shows a state where the separation unit 230 is held at the operation position by the plurality of unit regulating portions 24. In addition, FIG. 7 shows a state where the separation unit 230 is located at the initial position.

In the state where the separation unit 230 is located at the initial position, the retard roller 23 is separated from the feed roller 22 to be at a lower position than the feed roller 22 (see FIG. 7). In the state where the separation unit 230 is located at the operation position, the retard roller 23 is in contact with the feed roller 22 (see FIG. 6). The holder 231, at the operation position, presses the retard roller 23 against the feed roller 22.

When the sheet cassette 1 is drawn from the main body portion 100, the holding of the separation unit 230 by the plurality of unit regulating portions 24 is released, and the separation unit 230 moves from the operation position to the initial position (see FIG. 7). When the separation unit 230 is located at the initial position, the retard roller 23 is located at a lower position than the pickup roller 21 (see FIG. 7).

Accordingly, when the separation unit 230 is located at the initial position, the retard roller 23 is separated from the feed roller 22 and passes below the pickup roller 21.

In the present embodiment, when the sheet cassette 1 is drawn from the main body portion 100, the separation unit 230 moves from the operation position to the initial position by its own weight. As a result, there is no need to provide a special mechanism, such as a spring or a link mechanism, for causing the separation unit 230 to move from the operation position to the initial position.

When the sheet cassette 1 is drawn from the main body portion 100, the plurality of unit guide portions 13 of the holder support portion 12 guide the holder 231 that moves downward by its own weight, from the operation position to the initial position. Similarly, when the sheet cassette 1 is attached to the main body portion 100, the plurality of unit guide portions 13 guide the holder 231 that is lifted by the unit regulating portions 24, from the initial position to the operation position.

The plurality of unit regulating portions 24 include a pair of first unit regulating portions 241 and a pair of second unit regulating portions 242, wherein the pair of first unit regulating portions 241 come in contact with the pair of first protruding portions 2321, and the pair of second unit regulating portions 242 come in contact with the pair of second protruding portions 2322.

The pair of first unit regulating portions 241 include a pair of first guide support surfaces 241*a* and a pair of first holding surfaces 241*b*, wherein the pair of first guide support surfaces 241*a* are inclined upward in the attachment direction D11, and the pair of first holding surfaces 241*b* are continuous from the pair of first guide support surfaces 241*a* in the attachment direction D11 (see FIG. 5 to FIG. 7).

The pair of second unit regulating portions 242 include a pair of second guide support surfaces 242*a* and a pair of second holding surfaces 242*b*, wherein the pair of second guide support surfaces 242*a* are inclined upward in the attachment direction D11, and the pair of second holding surfaces 242*b* are continuous from the pair of second guide support surfaces 242*a* in the attachment direction D11 (see FIG. 5 to FIG. 7).

That is, the four holding surfaces composed of the pair of first holding surfaces 241*b* and the pair of second holding surfaces 242*b* are continuous from the four guide support surfaces 241*a* and 242*a* in the attachment direction D11. It is noted that in the present embodiment, the four holding surfaces 241*b* and 242*b* are flat surfaces. However, the four holding surfaces 241*b* and 242*b* may be curved surfaces of a recessed shape.

When the sheet cassette 1 is attached to the main body portion 100, the four protruding portions 232 move sliding on the pair of first guide support surfaces 241*a* and pair of second guide support surfaces 242*a*. This allows the separation unit 230 to move from the initial position to the operation position.

In other words, when the sheet cassette 1 is attached to the main body portion 100, the pair of first guide support surfaces 241*a* and pair of second guide support surfaces 242*a* guide the four protruding portions 232 so that the separation unit 230 moves from the initial position to the operation position.

In addition, as the four protruding portions 232 move along the pair of first guide support surfaces 241*a* and the pair of second guide support surfaces 242*a*, the holder 231 moves from the initial position to the operation position. It is noted that the pair of first guide support surfaces 241*a* and the pair of second guide support surfaces 242*a* are an example of a plurality of guide surfaces.

In addition, the four protruding portions 232 are supported by the pair of first holding surfaces 241*b* and the pair of second holding surfaces 242*b*, thereby the separation unit 230 is held at the operation position (see FIG. 7).

In the state where the sheet cassette 1 is attached to the main body portion 100, the retard roller 23 abuts on the feed roller 22 to restrict the separation unit 230 from moving upward, and the pair of first holding surfaces 241*b* and the pair of second holding surfaces 242*b* support the four protruding portions 232 to restrict the separation unit 230 from moving downward.

In addition, the four unit guide portions 13 restrict the four protruding portions 232 from moving in the first direction D1, thereby restricting the separation unit 230 from moving in the first direction D1.

In the image forming apparatus 10, removing the sheet cassette 1 from the main body portion 100 facilitates the replacement of the separation unit 230.

In addition, in a state where the four protruding portions 232 are not in contact with the four unit regulating portions 24 during attachment and detachment of the sheet cassette 1 to/from the main body portion 100, the separation unit 230 is held at the initial position by its own weight. As a result, during attachment and detachment of the sheet cassette 1 to/from the main body portion 100, when the separation unit 230 is located at the initial position, the separation unit 230 is not in contact with the main body portion 100 or components provided in the main body portion 100.

That is, when the sheet cassette 1 is attached to the main body portion 100, as the sheet cassette 1 moves in the attachment direction D11, the unit regulating portions 24 cause the holder 231 to move from the initial position to the operation position. When the sheet cassette 1 is attached to the main body portion 100, the unit regulating portions 24 cause the holder 231 to move from the initial position to the operation position after the retard roller 23 passes below the pickup roller 21.

Furthermore, when the sheet cassette 1 is drawn from the attachment position in the main body portion 100, the unit regulating portions 24 cause the holder 231 to move from the operation position to the initial position before the retard roller 23 reaches below the pickup roller 21. It is noted that the unit regulating portions 24 are an example of a moving mechanism.

With the above-described configuration, when the sheet cassette 1 is attached to or removed from the main body portion 100, the separation unit 230 and components provided in the main body portion 100 do not come in contact with each other and are not damaged thereby.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet feed device comprising:

a sheet cassette storing sheets and attached, along an attachment direction which is directed from an upstream side to a downstream side in a sheet feed direction, to a main body portion, the sheet cassette configured to be drawn from the main body portion in a direction opposite to the attachment direction;

a feed-out member provided in the main body portion and configured to come in contact with an upper surface of a sheet in the sheet cassette to feed out the sheet in the sheet feed direction;

a feeding member configured to feed the sheet fed out by the feed-out member to a conveyance path in the main body portion;

a separation member disposed to face the feeding member from below and configured to, together with the feeding member, separate the sheets one by one and feed a separated sheet;

a holder supporting the separation member;

a holder support portion provided in the sheet cassette and supporting the holder such that the holder can move in an up-down direction; and a moving mechanism provided in the main body portion, wherein when the sheet cassette is attached to the main body portion, as the sheet cassette is moved in the attachment direction, the moving mechanism causes the holder to move from an initial position to an operation position, when the holder is located at the initial position, the separation member is spaced from the feeding member and is able to pass below the feed-out member, when the holder is located at the operation position, the holder presses the separation member against the feeding member, when the sheet cassette is attached to the main body portion, the moving mechanism causes the holder to move from the initial position to the operation position after the separation member passes below the feed-out member, and when the sheet cassette is drawn from the main body portion, the moving mechanism causes the holder to move from the operation position to the initial position before the separation member reaches below the feed-out member.

2. The sheet feed device according to claim 1, wherein when the sheet cassette is drawn from the main body portion, the holder support portion guides the holder so that the holder moves downward by its own weight, from the operation position to the initial position.

3. The sheet feed device according to claim 2, wherein the holder support portion is provided on a front surface of the sheet cassette in the attachment direction, and the holder is attached on the sheet cassette by being placed on the holder support portion and is removed from the sheet cassette by being lifted from the holder support portion.

4. The sheet feed device according to claim 1, wherein the holder includes a plurality of protruding portions that protrude outward from both sides of the holder along a direction crossing the attachment direction, the holder support portion includes a plurality of support grooves that respectively guide the plurality of protruding portions in the up-down direction, the moving mechanism includes a plurality of guide surfaces that are inclined upward in the attachment direction and configured to guide the plurality of protruding portions, and when the sheet cassette is attached to the main body portion, the plurality of protruding portions move along the plurality of guide surfaces, thereby the holder moves from the initial position to the operation position.

5. The sheet feed device according to claim 1, wherein the main body portion includes a cassette facing portion that faces a front surface portion of the sheet cassette, and the cassette facing portion includes the moving mechanism and a feed sheet guide that is configured to guide the sheet fed by the feeding member to the conveyance path.

6. An image forming apparatus comprising:

the sheet feed device according to claim 1; and a print portion configured to form an image on a sheet fed by the sheet feed device.

* * * * *